US005309982A

United States Patent [19]

Aliano

[11] Patent Number: 5,309,982

[45] Date of Patent: May 10, 1994

[54] HEAT EXCHANGER FOR EXPOSED PIPES

[76] Inventor: Sal Aliano, 83 Main St. Apt. 7A, Newington, Conn. 06111

[21] Appl. No.: 719,335

[22] Filed: Jun. 21, 1991

[51] Int. Cl.[5] ..... F28F 1/20

[52] U.S. Cl. ..... 165/76; 165/181; 165/182

[58] Field of Search ..... 165/76, 181, 182

[56] References Cited

U.S. PATENT DOCUMENTS 2,739,213 3/1956 Beckjord ..... 165/181 X

FOREIGN PATENT DOCUMENTS 823926 12/1951 Fed. Rep. of Germany ..... 165/181
492164 3/1954 Italy ..... 165/181
19447 of 1896 United Kingdom ..... 165/181
575444 2/1946 United Kingdom ..... 165/181

*Primary Examiner*—Allen J. Flanigan

[57] ABSTRACT

A heat exchanger apparatus for more effective use of a heat or hot water pipe as a radiant heat source. A pair of tubular members having a semi-circular lateral cross-section and outwardly extending fins attach to the outside surface of a pipe. The tubular members are held adjacent to the pipe by a spring clamp.

4 Claims, 2 Drawing Sheets

HEAT EXCHANGER FOR EXPOSED PIPES

BACKGROUND OF THE INVENTION

The present invention generally relates to space heaters. More specifically, this invention relates to an apparatus for the dispersion of heat from a pipe exposed in a room. A method of heating a room is also disclosed in the present invention.

In some residential buildings, particularly in the northeastern part of the United States, heat and hot water pipes are disposed to the inside of the walls of a room (as opposed to being constructed within the walls). These pipes represent a source of heat which can be used to warm a room. It is well known in heat exchanger technology that heat transfer between a pipe and the ambient air can be increased by increasing the transfer surface area. This principal has; led to the use of finned tubing in heat exchangers and the like. The present invention utilizes this principal to provide a heat exchanger apparatus permitting more effective and selective use of exposed heat and hot water pipes as radiant heat sources.

A heat exchanger for a combustion heater is disclosed in U.S. Pat. No. 4,657,074. Various other heat exchangers are also known in the prior art. Exemplary prior art heat exchangers are shown in U.S. Pat. No. 1,983,549 to Krackowizer which discloses plate fins having punched lugs arranged in an unsymmetripal manner over a plurality of tubes; U.S. Pat. No. 1,891,538 to Hicks which discloses a plurality of fins having notches at the corners thereof which are soldered to metal tubing; and U.S. Pat. No. 2,540,339 to Kritzer which discloses transversely-interlocked coil and fins. Further evidence of the prior art is illustrated in U.S. Pat. Nos. 1,988,494; 2,007,000; 2,007,001; 2,021,117; 2,051,402; 2,136,222; 2,189,652; 2,268,361; 2,602,650; 2,868,515; and 3,407,874. To the Applicant's knowledge no heat exchanger apparatus having the construction and directed to the purposes of the present invention is disclosed in the prior art.

SUMMARY OF THE INVENTION

The heat exchanger apparatus of the present invention comprises clamping means and first and second elements respectively comprising a tubular member having a semi-circular lateral cross-section and a plurality of fins projecting radially outward from the convex surface of the tubular member. In use the first and second elements are selectively attached to the outside surface of a heat or hot water pipe by the clamping means.

An object of this invention is to provide a heat exchanger apparatus that can be selectively attached to an exposed heat or hot water pipe.

Another object of this invention is to provide means to improve the effectiveness of exposed heat and hot water pipes as radiant heat sources.

A further object of the present invention is to provide means to increase the temperature within a room without increasing energy costs.

It is also an object of this invention to provide an inexpensive and easily attachable heat exchanger for exposed heat and hot water pipes.

These and other objects and advantages of the present invention will be apparent to those skilled in the art from the following description of a preferred embodiment, claims and appended drawings.

DESCRIPTION OF A PREFERRED EMBODIMENT

Figure 1:
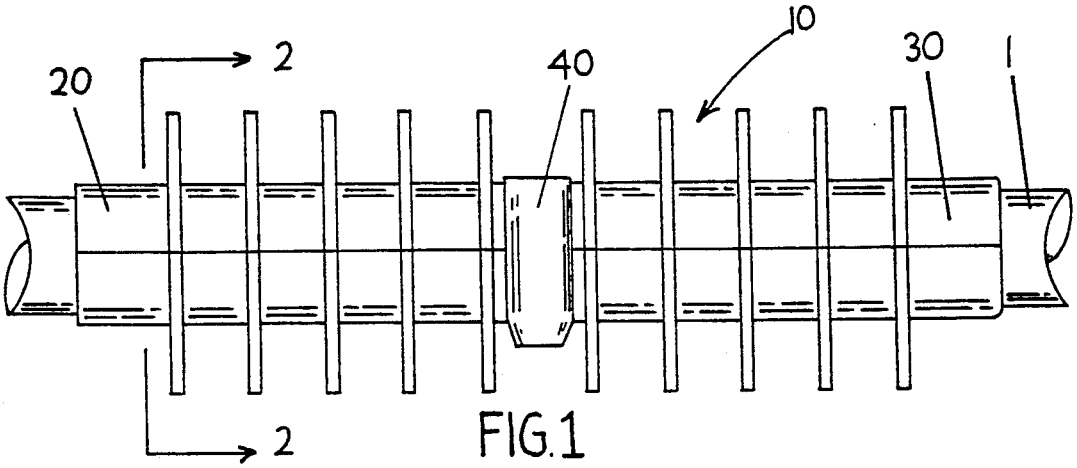
FIG. 1 is a side elevational view of the heat exchanger apparatus of the present invention shown attached to a vertically-disposed hot water pipe.
Figure 2:
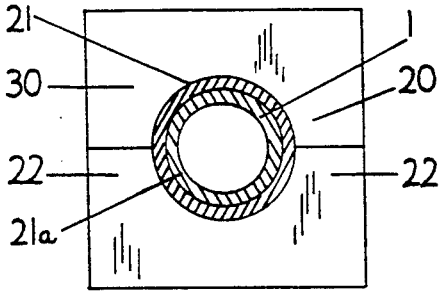
FIG. 2 is a cross-sectional end view taken along line 2—2 of FIG. 1.

FIG. 1 illustrates the attachment of the heat exchanger apparatus 10 of the present invention to an exposed heat or hot water pipe 1. Heat exchanger apparatus 10 comprises a first element 20 and a second element 30 selectively attachable to the pipe 1 by clamping means 40. Clamping means 40 is disposed about a central portion 21*c* of the apparatus 10. In the preferred embodiment of heat exchanger apparatus 10 first element 20 and second element 30 are identically formed having a semi-circular lateral cross-section (FIG. 2) and are disposed having the inner, concave surface 21*a* thereof adjacent to pipe 1. Thereby the pipe 1 can be selectively made useful as a radiant heat source. A plurality of heat exchanger apparatuses 10 may be disposed end-to-end along the length of pipe 1.

Figure 3:
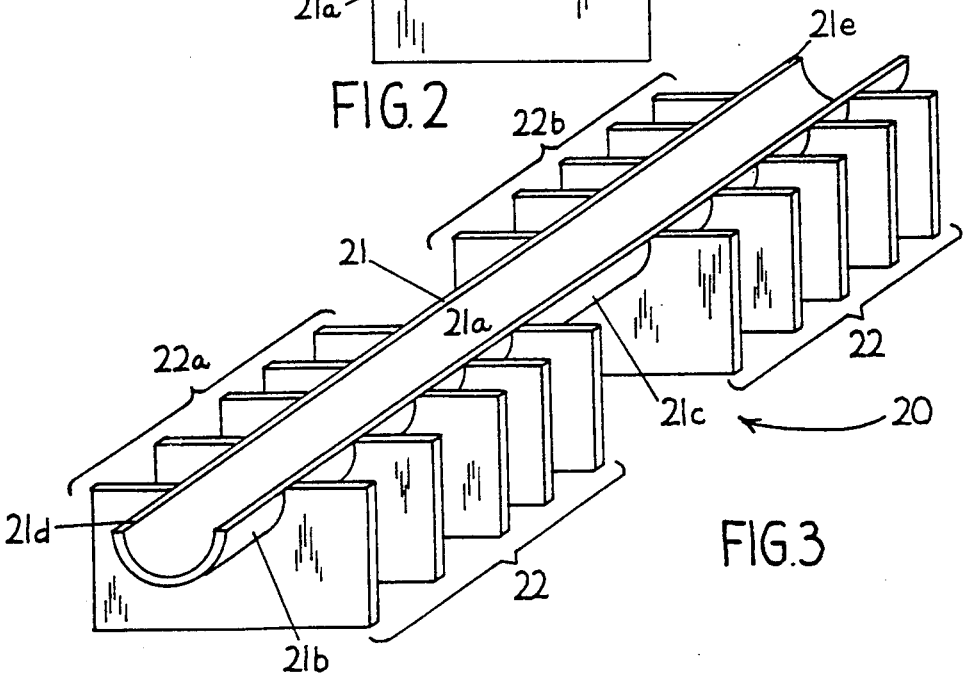
FIG. 3 is a perspective view of a first element of the heat exchanger apparatus of the present invention.
Figure 4:
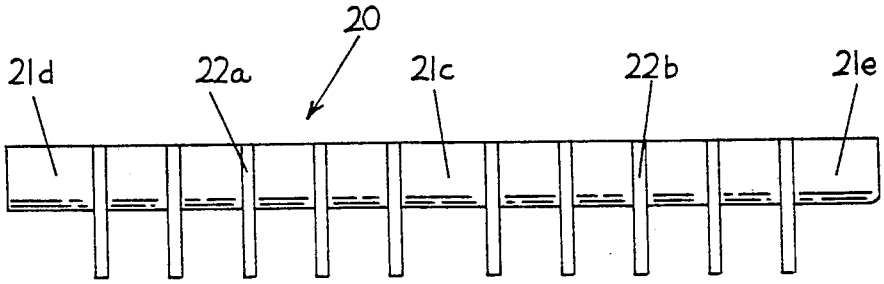
FIG. 4 is a side elevational view of the first element shown in FIG. 3.

The following description of first element 20 is applicable to the second element 30 since first and second elements 20, 30 are identically formed. As can be seen in the perspective view of first element 20 illustrated in FIG. 3, first element 20 generally comprises a length of heat conductive material, preferably metal tubing 21 having a semi-circular lateral cross-section, and a plurality of fins 22 disposed on the outer, convex surface 21*b* of the tubing 21. The plurality of fins 22 comprises a first array of fins 22*a* and a second array of fins 22*b*. The first and second array of fins 22*a*, 22*b* are disposed in spaced relationship from a central portion 21*c* of the tubing 21 and from respective first end 21*d* and second end 21*e* of the tubing 21 (FIG. 4).

Figure 5:
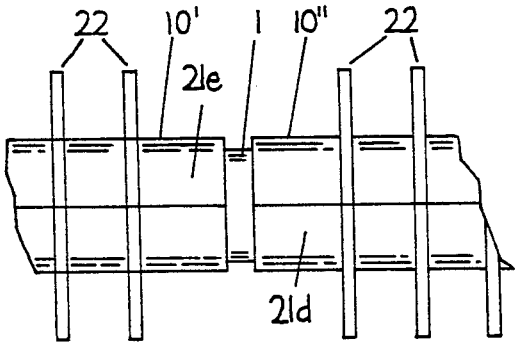
FIG. 5 is a partial side elevational view of first and second heat exchanger apparatuses disposed end-to-end showing respective ends thereof disconnected.
Figure 6:
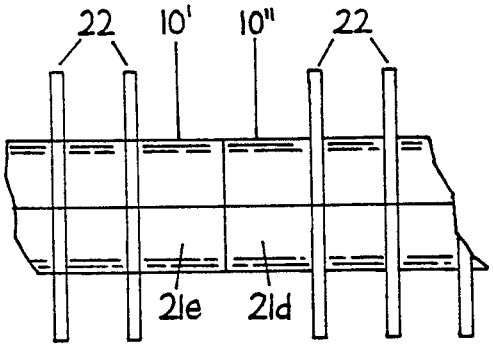
FIG. 6 is a partial side elevational view of first and second heat exchanger apparatuses disposed end-to-end showing respective ends thereof connected.

FIG. 5 illustrates disconnected, adjacently-disposed ends of first and second heat exchanger apparatuses 10' and 10'' disposed end-to-end along the length of a pipe 1. A second end 21*e* of the tubing 21 of the first apparatus 10' is beveled. The adjacently-disposed first end 21*d* of the tubing 21 of the second apparatus 10'' is formed to engage the beveled second end 21*e* of the first apparatus 10' (FIG. 6).

Figure 7:
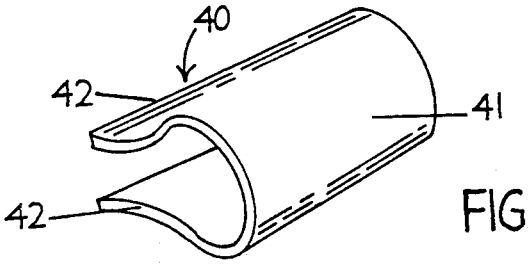
FIG. 7 is a perspective view of the spring clamp of the present invention.

FIG. 7 illustrates a perspective view of a spring clamp 40, the preferred embodiment of the clamping means of the present invention. Spring clamp 40 comprises a length of resilient material 41 curved along its length and having a flange 42 extending from the respective ends of the length of resilient material 41. The curvature of the length of resilient material 41 is such that spring clamp 40 tightly engages the central portions 21c of the tubing 21 of the first and second elements 20, 30 when disposed about a pipe 1 (FIG. 1). It should understood that the first and second elements 20, 30 and corresponding spring clamp 40 may be formed having various radii and curvature to engage pipe 1 of varying diameter. Spring clamp 40 is selectively releasable from the apparatus 10 by spreading apart the respective flanges 42 of the spring clamp 40.

The heat exchanger apparatus 10 of the present invention provides a simple means to make more effective use of an exposed heat or hot water pipe 1 as a heat source. The rising cost of energy demands more efficient use of heat sources as one means to conserve energy. Conservation measures can be built into new constructions. The present invention provides a novel and energy conserving means and method for heating a room in existing structures.

Therefore, in view of the foregoing I claim:

1. A heat exchanger apparatus selectively attachable to a heat or hot water pipe to improve the effectiveness of the pipe as a radiant heat source, said heat exchanger apparatus comprising a first element comprising a length of heat conductive material having a plurality of fine extending outwardly from an outer side thereof;

a second element comprising a length of heat conductive material having a plurality of fine extending outwardly from an outer side thereof, said first element and said second element being respectively formed having a first end and a second end, said first end and said second end being mutually cooperable thereby permitting end-to-end engagement of a plurality of heat exchanger apparatuses, said second end being beveled; and clamping means, said first element and said second element being selectively attachable to a pipe having inner sides thereof disposed adjacent to the pipe and being fixedly attachable to the pipe by said clamping means.

2. A heat exchanger apparatus as in claim 1 wherein said clamping means comprises a spring clamp.

3. A heat exchanger apparatus as in claim 1 wherein said plurality of fins in the respective first element and second element comprises a first array of fins and a second array of fins, said first array of fins and said second array of fins being disposed in spaced relationship from a central portion of the respective first element and second element and from respective ends of the respective first element and second element.

4. A heat exchanger apparatus selectively attachable to a heat or hot water pipe to improve the effectiveness of the pipe as a radiant heat source, said heat exchanger apparatus comprising a first element comprising a first length of heat conductive material formed having a semi-circular lateral cross-section thereby said first heat conductive material having a concave surface and a convex surface, and a first array of fins and a second array of fins extending outwardly from the convex surface of the first length of heat conductive material;

a second element comprising a second length of heat conductive material formed having a semi-circular lateral cross-section thereby said second heat conductive material having a concave surface and a convex surface, and a first array of fins and a second array of fins extending outwardly from the convex surface of the second length of heat conductive material, said first array of fins and said second array of fins of the respective first element and second element being disposed in spaced relationship from a central portion of the respective first element and the second element and from a first end and a second end of the respective first element and second element, said second end being beveled, said first end and said second end being formed for mutually cooperable engagement; and a spring clamp, said first element and said second element being selectively attachable to a pipe having the concave surfaces of the respective first element and second element disposed adjacent to the pipe and being fixedly attachable to the pipe by said spring clamp.

* * * * *